US009777348B2

(12) United States Patent
Kimura et al.

(10) Patent No.: US 9,777,348 B2
(45) Date of Patent: Oct. 3, 2017

(54) COPPER ALLOY AND COPPER ALLOY MANUFACTURING METHOD

(75) Inventors: Hisamichi Kimura, Watari-Gun (JP); Naokuni Muramatsu, Nagoya (JP); Ken Suzuki, Nagoya (JP)

(73) Assignees: Akihisa Inoue, Sendai, Miyagi-Ken (JP); Hisamichi Kimura, Iwanuma, Miyagi-Ken (JP)

( * ) Notice: Subject to any disclaimer, the term of this patent is extended or adjusted under 35 U.S.C. 154(b) by 1369 days.

(21) Appl. No.: 12/714,696

(22) Filed: Mar. 1, 2010

(65) Prior Publication Data

US 2010/0147483 A1 Jun. 17, 2010

Related U.S. Application Data

(62) Division of application No. 11/084,692, filed on Mar. 18, 2005, now abandoned.

(30) Foreign Application Priority Data

Mar. 29, 2004 (JP) ..... 2004-096654

(51) Int. Cl.
*C22C 9/00* (2006.01)
*C22F 1/08* (2006.01)
*H01B 1/02* (2006.01)

(52) U.S. Cl.
CPC ..... *C22C 9/00* (2013.01); *C22F 1/08* (2013.01); *H01B 1/026* (2013.01)

(58) Field of Classification Search
USPC ..... 148/553, 554, 679–687
See application file for complete search history.

(56) References Cited

U.S. PATENT DOCUMENTS 1,358,620 A * 11/1920 Clark ..... 432/211
4,067,750 A 1/1978 Mravic et al.
(Continued)

FOREIGN PATENT DOCUMENTS

GB 2311297 9/1997
JP 50-122417 9/1975
(Continued)

OTHER PUBLICATIONS

Shigenori Hori et. al, , A Thermomechanical Treatment of Cu—Zr Alloys, Journal of the Japan Copper and Brass Research Association, vol. 29 (1990), pp. 160-168. (translated copy, pp. 1-23).*
(Continued)

*Primary Examiner* — Keith Walker
(74) *Attorney, Agent, or Firm* — Burr & Brown, PLLC

(57) ABSTRACT

A method of manufacturing a copper alloy is provided, including melting and casting a copper alloy having a composition expressed, in atomic percent, by a formula of $Cu_{100-(a+b)}Zr_aB_b$, wherein $1.0 \leq a \leq 8.0$, $0 \leq b \leq 4.0$, and $a+b \leq 8.0$, by a nonrefractory melting method. A cold working with a reduction of about 50% or more for the copper alloy without a solution treatment is performed to provide the copper alloy a dual phase structure having a layered structure including a Cu matrix phase having a plurality of grain particles having an average diameter of about 10 μm or less, and an eutectic phase around the Cu matrix phase. At least part of each grain particle contacts another grain particle within the eutectic phase, and the eutectic phase includes at least one of a Cu—Zr compound and a Cu—Zr—B compound.

2 Claims, 6 Drawing Sheets

(56) References Cited

U.S. PATENT DOCUMENTS

| | | | | |
|---|---|---|---|---|
| 4,749,548 | A | 6/1988 | Akutsu et al. | |
| 4,755,235 | A | 7/1988 | Matidori | |
| 4,804,034 | A * | 2/1989 | Leatham et al. | 164/46 |
| 4,872,048 | A | 10/1989 | Akutsu et al. | |
| 5,017,250 | A * | 5/1991 | Ashok | 148/411 |
| 5,149,498 | A | 9/1992 | Nilmen et al. | |
| 5,306,465 | A | 4/1994 | Caron et al. | |
| 5,889,813 | A * | 3/1999 | Fujita et al. | 373/156 |
| 2002/0005235 | A1 | 1/2002 | Helmenkamp et al. | |

FOREIGN PATENT DOCUMENTS

| | | | |
|---|---|---|---|
| JP | 57-009850 | | 1/1982 |
| JP | 60-046340 | | 3/1985 |
| JP | 60-211026 | | 10/1985 |
| JP | 60211026 | A * | 10/1985 |
| JP | 60211028 | A * | 10/1985 |
| JP | 61-210138 | | 9/1986 |
| JP | 62-240732 | | 10/1987 |
| JP | 04-074837 | | 3/1992 |
| JP | 04-165055 | | 10/1992 |
| JP | 06-330218 | | 11/1994 |
| JP | 06-346206 | | 12/1994 |
| JP | 07-011363 | | 1/1995 |
| JP | 07-054079 | A1 | 2/1995 |
| JP | 08-218155 | | 8/1996 |
| JP | 10-183274 | A1 | 7/1998 |
| JP | 2005-133185 | | 5/2005 |
| KR | 2002-0003507 | A1 | 1/2002 |

OTHER PUBLICATIONS

Hisamichi Kimura, et al., *Mechanical and Electric Properties of Rapidly Solidified Cu-based Alloys*, Journal of the JRICu, vol. 42, No. 1 (2003), pp. 193-197.

* cited by examiner

COPPER ALLOY AND COPPER ALLOY MANUFACTURING METHOD

CROSS REFERENCE TO RELATED APPLICATIONS

This application is based upon U.S. application Ser. No. 11/084,692, filed Mar. 18, 2005, and claims the benefit of priority from the prior Japanese Patent Application No. 2004-96654, filed on Mar. 29, 2004; the entire contents of which are incorporated herein by reference.

BACKGROUND OF THE INVENTION

1. Field of the Invention

The present invention relates to a copper alloy having both tensile strength and electric conductivity, which is utilized mainly for connectors and sockets, and a method of manufacturing the same.

2. Description of the Related Art

Strips, foils, sheets and rods made of a copper alloy which is press-molded/stamping have been used for general electronic parts. In designing such a copper alloy, the copper alloy is desired to have both tensile strength and electric conductivity, which are contradicting properties. Furthermore, a copper alloy used for electronic parts loaded onto automobiles is desired to have a heat-resistance property in addition to the tensile strength and electric conductivity.

Cu—Zr based alloys are well known as heat resistance lead frame materials. Cu—Zr based alloys increase their heat-resistance property by solid solution of a small amount of Zr into Cu. In Cu—Zr based alloys, Zr supersaturated at a high temperature generates a stabilized compound together with Cu with an aging treatment, thus precipitating. As a result, Cu—Zr based alloys increase their tensile strength (refer to Patent No. 2501275, for example).

However, when Zr is added unnecessarily, a problem arises in that the electric conductivity is decreased. Further, coarse crystals and precipitations which do not contribute to the tensile strength of Cu—Zr based alloys remain, and have a possibility to role as original points of cracks at the time when the Cu—Zr based alloys are press-molded/stamping to make electronic parts such as connectors.

Therefore, the addition of Zr which is considered to be proper has been set roughly from 0.005 to 0.25% in terms of weight ratio (refer to Japanese Patent Laid-Open No. H10 (1998)-183274, for example).

However, in such Cu—Zr based alloys, the combination of tensile strength σ (ultimate tensile strength σ) and electric conductivity δ are σ: 300 MPa-δ: 90% IACS ("Precipitation of Alloy" by Nariyasu Kohda, Maruzen, pp 442, FIG. 13.3, issued on Jul. 25, 1972).

Herein, in designing the copper alloy, a dimensionless performance index value M=σ(MPa)*δ(% IACS) is defined to indicate a balance between the tensile strength σ and the electric conductivity δ, which contradict each other. The dimensionless performance index value M of conventional Cu—Zr based alloys remained approximately 270 (300*0.9). Since the conventional Cu—Zr based alloys have a small value of the dimensionless performance index value M, its applicable scope is limited. When a property including both tensile strength σ and electric conductivity δ is required, the conventional Cu—Zr based alloys can not be applicable.

Accordingly, as a copper alloy having a property in that both the tensile strength σ and the electric conductivity δ are high, the copper alloy satisfying an inequality expressed by M>400 is eagerly desired.

On the other hand, in order to increase the value of the dimensionless performance index value M of a Cu—Zr based alloy, the addition of a third element has already been tried.

For example, in Japanese Patent Laid-Open No. H10 (1998)-183274, several copper alloys having the dimensionless performance index value M equal to about 600*0.7=420 have been proposed by adding a small amount of many elements such as Cr and Zn to a Cu—Zr based alloy.

However, exemplification of an alloy achieving the dimensionless performance index value M more than 400 while having a higher tensile strength a (high strength) does not exist. Therefore, there has been a problem in that such a Cu—Zr based alloy is used only for an extremely limited application.

Furthermore, when a Cu—Zr based alloy ends its nominal life as an electronic part and when it is reused as a re-melted raw material, there is a problem in that maintenance of such multiple system alloy scraps is extremely troublesome.

SUMMARY OF THE INVENTION

In light of the foregoing problems, the inventors of this application examined the properties of thin strips having thicknesses of 30 to 50 μm, which are respectively made of $Cu_{95}Zr_3M_2$ (M: Ti, V, Nb, Cr, Mn, Fe, Co, Ni, or Al) and $Cu_{100-x}Zr_x$ (x: 0 to 5) by use of a single roll type casting method, which is one way to obtain an amorphous thin strip by casting.

As a result, the inventors of this application found that in Cu-5% Zr (by atomic percent), a multiphase structure composed of a Cu matrix and a $Cu_9Zr_2$ compound is obtained, and that a grain diameter of the Cu matrix is extremely small ("Copper and Copper Alloy", Vol. 42, No. 1, pages 193 through 197, issued in 2003).

However, the tensile strength σ (ultimate tensile strength σ) of the copper alloy was about 1080 MPa, and its electric conductivity δ was about 24% IACS (% of International Annealed Copper Standard). A dimensionless performance index value M of the copper alloy remained at about 259 (1080*0.24).

Thereafter, the inventors of this application found a copper alloy in which a composition by atomic percent is expressed by a compositional formula of $Cu_{100-(a+b)}Zr_aB_b$ ($0.05 \le a \le 8.0$, $0 \le b \le 4.0$, and $a+b \le 8.0$), and completed the present invention.

An object of the present invention is to provide a copper alloy which has a dimensionless performance index value M satisfying an inequality M>400, and which can be applied to a wide range of electronic parts, in a simple alloy composition of a binary system containing Cu and Zr or of a ternary system containing Cu, Zr, and B. Further, another object of the present invention is to provide a method of manufacturing the same.

In order to achieve the foregoing objects, a first aspect of the present invention is a copper alloy in which a composition by atomic percent is expressed by a composition formula: $Cu_{100-(a+b)}Zr_aB_b$, and a dual phase structure, layered with a plurality of Cu matrices constituted by grain particles and with an eutectic phase constituted by the Cu matrices and any of a Cu—Zr compound and a Cu—Zr—B compound, is constituted. As for the grain particles, at least a part of each of the grain particles contacts other grain particles, and in $Cu_{100-(a+b)}Zr_aB_b$, "a", "b" and "(a+b)" satisfy $0.05 \leq a \leq 8.0$, $0 \leq b \leq 4.0$, and $a+b \leq 8.0$.

The second aspect of the present invention according to the first aspect of the present invention is the copper alloy in which an average diameter of the grain particles is about 10 μm or less.

A third aspect of the present invention is the copper alloy according to the first or second aspect, in which in the dual phase structure, a precipitation containing at least one of a Cu—Zr compound, a Cu—B compound and a Cu—Zr—B compound is dispersed in the grain particles.

A fourth aspect of the present invention is a method of manufacturing the copper alloy according to the first through third aspects of the present invention, the method comprising the steps of melting and casting the copper alloy by a nonrefractory melting method (which is a method of melting without refractory crucible), and performing a cold working with a reduction of about 50% or more for the copper alloy.

A fifth aspect of the present invention is the method according to the fourth aspect of the present invention, the method further comprising the step of performing a thermal treatment to the copper alloy at a temperature in a range from 550 to 800° C. and for 1 to 5 hours, immediately before the step of performing the cold working.

A sixth aspect of the present invention is the method according to the fourth or fifth aspect of the present invention, the method further comprising the step of performing an aging treatment for the copper alloy at a temperature in a range from 300 and 500° C. and for 1 to 10 hours, after the step of performing the cool working.

According to the foregoing aspects of the present invention, a dual phase structure constituted by a Cu matrix and either or both of a Cu—Zr—B compound and a Cu—Zr compound is obtained around the fine grain particles of the Cu matrix, and a sufficient tensile strength can be acquired.

When an average diameter of the grain particles of the Cu matrix is no more than 10 μm, the dual phase structure can be effectively obtained, and the number of grain particles contacting other grain particles and the total contact area of the grain particles increase. Therefore, the tensile strength and the electric conductivity of the copper alloy are increased.

In the dual phase structure, the precipitation containing at least one of a Cu—Zr compound, a Cu—B compound and a Cu—Zr—B compound is dispersed in the grain particles, whereby the tensile strength is further increased.

Specifically, according to the foregoing aspects of the present invention, the copper alloy can be provided, which can be applied to a wide range corresponding to the application of electronic parts, and which is excellent in the tensile strength, electric conductivity and heat-resistance property. Furthermore, the method of manufacturing the copper alloy can be provided.

The copper alloy according to the foregoing aspects of the present invention is constituted by a simple binary system alloy composition containing Cu and Zr or by a simple ternary system alloy composition containing Cu, Zr and B. Therefore, it is possible to efficiently conduct maintenance of such a copper alloy when it is reused as re-melted raw materials in the form of alloy scraps after electronic parts using the copper alloy end its nominal life.

DETAILED DESCRIPTION OF THE INVENTION

A copper alloy according to this embodiment, which has both of the tensile strength and electric conductivity, has a composition by atomic percent being expressed by a composition formula: $Cu_{100-(a+b)}Zr_aB_b$. The copper alloy according to this embodiment constitutes a dual phase structure having a layered structure formed by a plurality of Cu matrices constituted by grain particles and by an eutectic phase constituted by the Cu matrices and any of a Cu—Zr compound and a Cu—Zr—B compound.

At least part of each of the grain particles constituting the Cu matrix contacts other adjacent grain particles. In the composition formula: $Cu_{100-(a+b)}Zr_aB_b$, "a", "b" and "(a+b)" satisfy $0.05 \leq a \leq 8.0$, $0 \leq b \leq 4.0$, and $a+b \leq 8.0$.

An average diameter of the grain particles in the copper alloy according to this embodiment should be preferably about 10 μm or less.

In a dual phase structure of the copper alloy according to this embodiment, a precipitation containing at least one of a Cu—Zr compound, a Cu—B compound and a Cu—Zr—B compound is dispersed in the grain particles.

A method of manufacturing the copper alloy according to this embodiment comprises the steps of melting and casting copper alloy by a nonrefractory melting method, and performing cold working with a reduction of about 50% or more for the copper alloy after the step of melting and casting the copper alloy.

Preferably, the method of manufacturing copper alloy according to this embodiment further comprises the step of performing a thermal treatment for the copper alloy at a temperature between 550° C. and 800° C. and for 1 to 5 hours, immediately before the step of performing the cold working.

Preferably, the method of manufacturing copper alloy according to this embodiment further comprises the step of performing an aging treatment for the copper alloy at a temperature between 300° C. and 500° C. and for 1 to 10 hours, after the step of performing the cold working.

The embodiments of the present invention will be described concretely hereinafter with reference to the accompanying drawings.

(Constitution of Copper Alloy According to this Embodiment and Properties Thereof)

Figure 1:
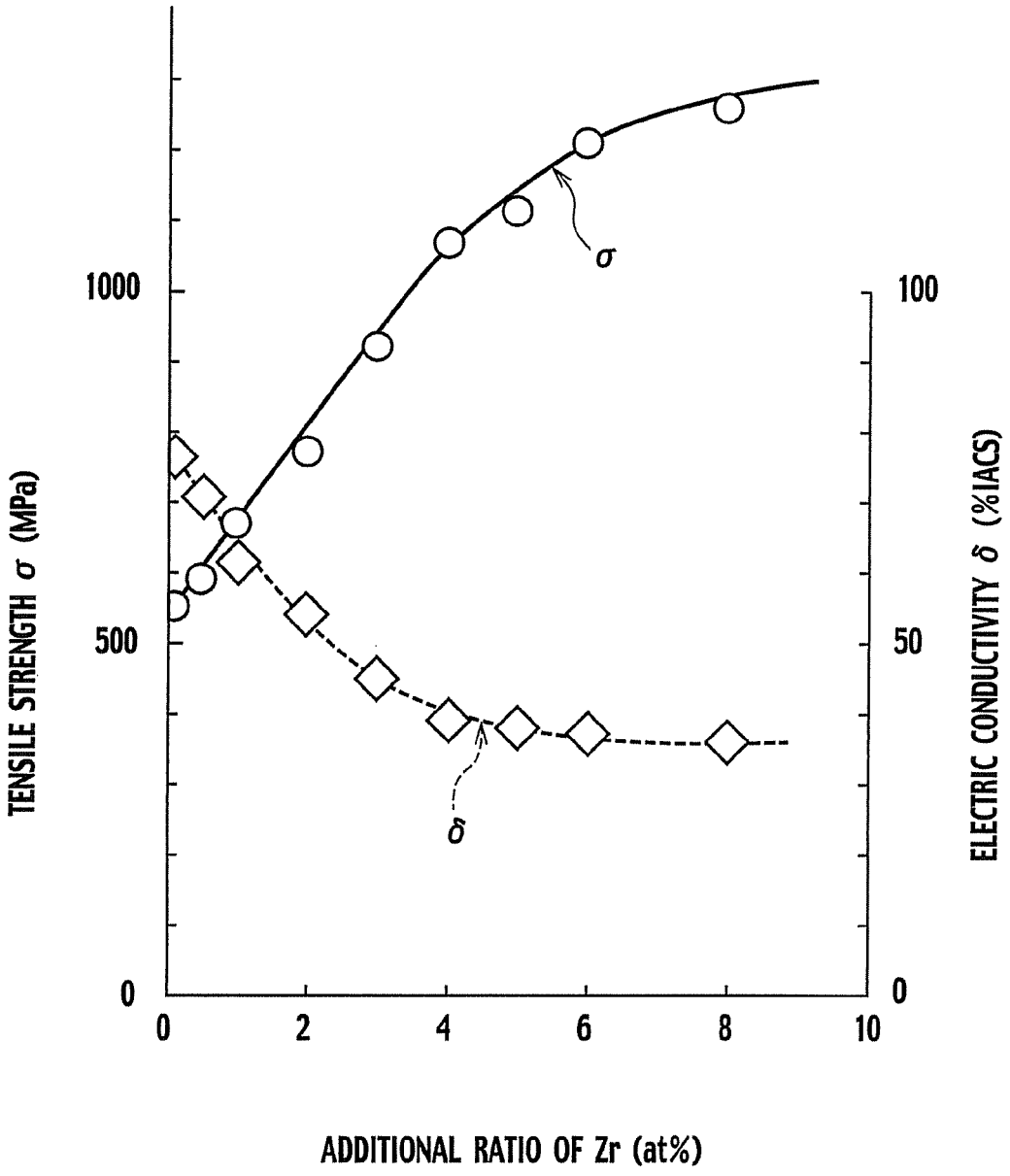
FIG. 1 is a graph showing measured results of a tensile strength and an electric conductivity versus an addition ratio of Zr, in a Cu—Zr based alloy according to a first embodiment of the present invention.

FIG. 1 is a graph showing measurement results of the tensile strength σ (ultimate tensile strength σ, hereinafter referred to as tensile strength σ) and electric conductivity δ versus an additional ratio of Zr, in a Cu—Zr based alloy according to a first embodiment of the present invention.

In this embodiment, a Cu—Zr based alloy was melted by levitation melting which is one of the nonrefractory melting methods. Subsequently, the melted Cu—Zr based alloy was cast by use of a Cu mold, and a plate-shaped bulk specimen having a thickness of about 10 mm was prepared.

Further, after the plate-shaped bulk specimen was cut to a proper dimension, the specimen was subjected to a cold rolling with a yield of 90% to 98%, thus making a sheet having a thickness of about 0.2 mm. The measured results of the tensile strength σ and electric conductivity δ for the sheet are shown in FIG. 1.

Figure 5:
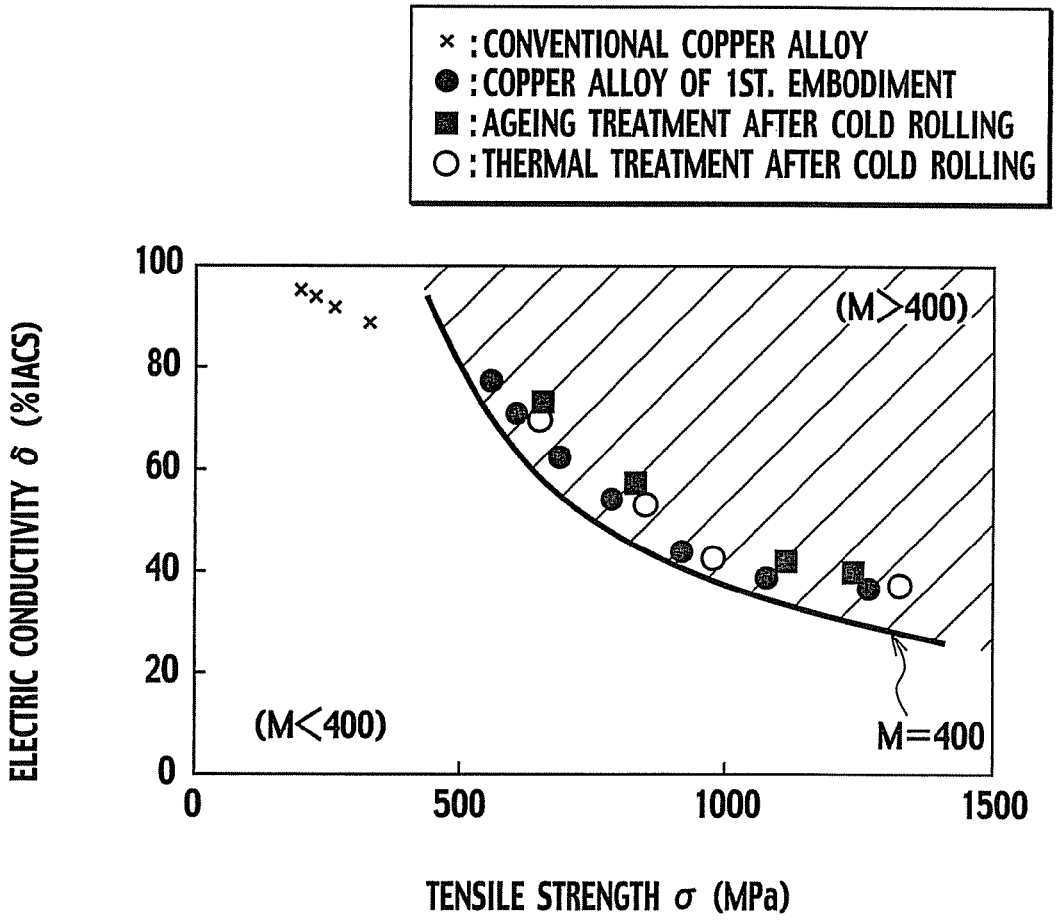
FIG. 5 is a graph showing a dimensionless performance index value M of a Cu—Zr based alloy containing the copper alloy according to the first embodiment.

Values for a dimensionless performance index value M, which are determined based on the tensile strength σ and electric conductivity δ, are indicated by the symbols "●" in FIG. 5.

In FIG. 5, the symbols "■" indicate the measured results in the cases where an aging treatment was performed for the specimen at 450° C. for two hours after the cold working (cold rolling).

Furthermore, the symbols "○" indicate the measured results in the cases where a thermal treatment was performed for the specimen at 650° C. for one hour before the cold working (cold rolling).

The curve in FIG. 5 indicates a combination of the tensile strength σ and electric conductivity δ in which the dimensionless performance index value M is 400. In addition, the symbols "x" indicate the measured results obtained for the conventional copper alloy, which are described in "Precipitation of Alloy" by Nariyasu Kohda, Maruzen, pp 442, FIG. 13.3, issued on Jul. 25, 1972.

As shown in FIG. 5, the dimensionless performance index value M of more than 400 which has not been heretofore achieved, can be obtained over a wide range (slant line portion in FIG. 5) in this embodiment.

Figure 2:
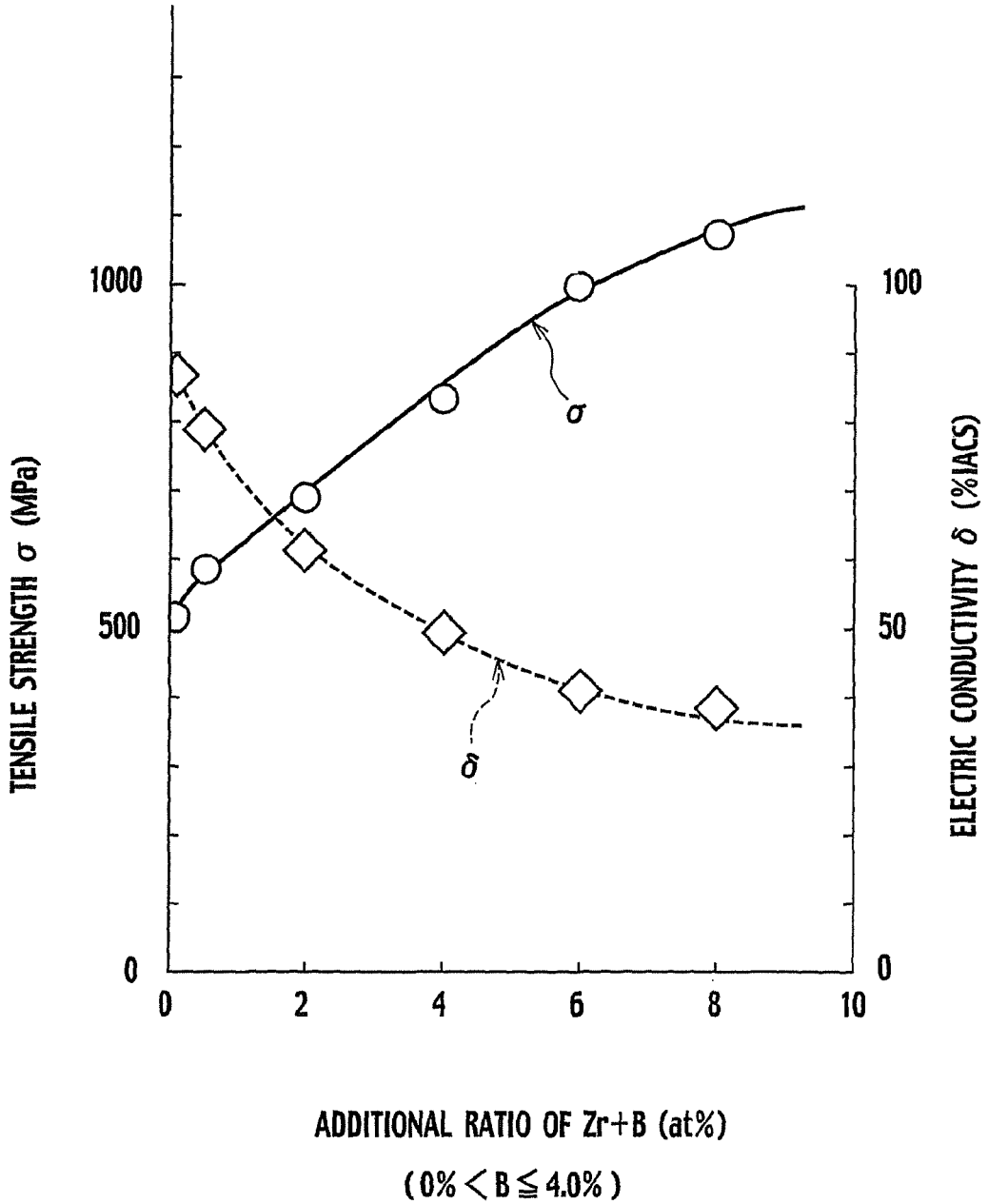
FIG. 2 is a graph showing measured results of a tensile strength and an electric conductivity versus an addition ratio of Zr, in a Cu—Zr—B based alloy according to a second embodiment of the present invention.

FIG. 2 is a graph showing measurement results of the tensile strength σ and electric conductivity δ versus an addition ratio of Zr, in a Cu—Zr—B based alloy according to a second embodiment of the present invention.

In this embodiment, the Cu—Zr—B based alloy was melted by a vacuum arc melting method which is one of the nonrefractory melting methods. Subsequently, the melted Cu—Zr—B based alloy was cast by use of a Cu mold, and a plate-shaped bulk specimen having a thickness of about 25 mm was prepared.

Furthermore, after the plate-shaped bulk specimen was cut to a proper dimension, the specimen was subjected to cold rolling with a reduction of 90% to 97%, thus making a sheet having a thickness of about 0.2 mm. The measured results of the tensile strength σ and electric conductivity δ for the sheet are shown in FIG. 2.

Figure 6:
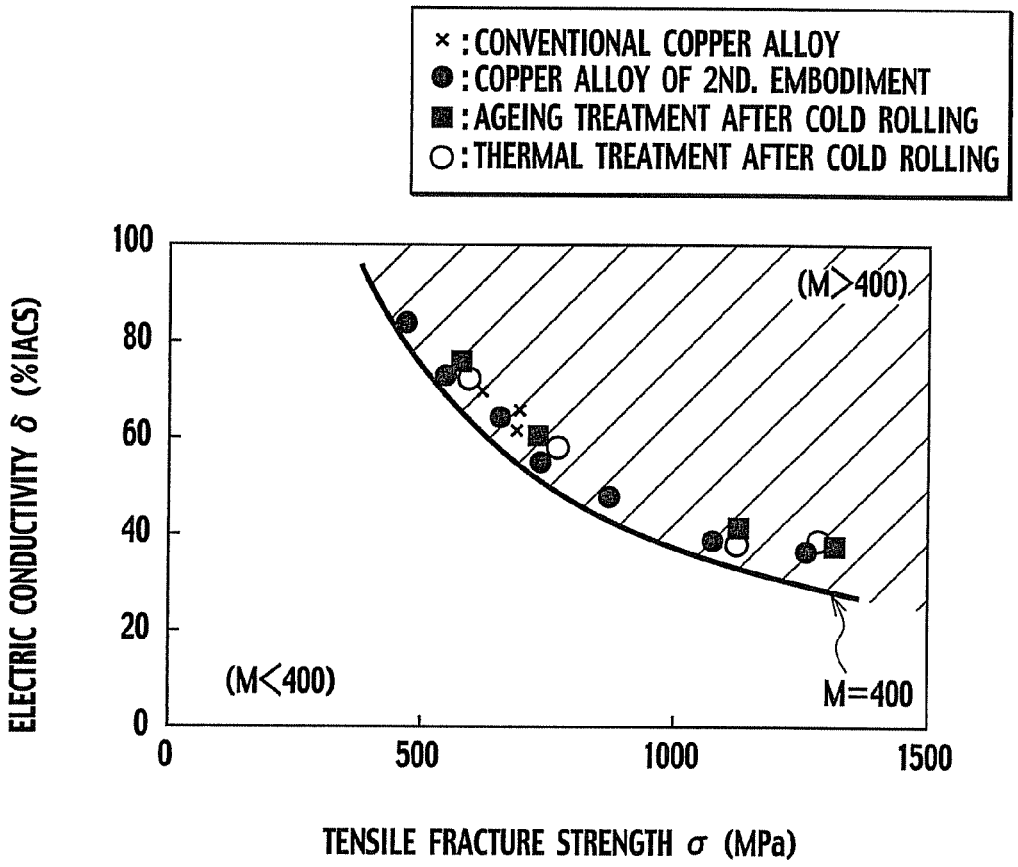
FIG. 6 is a graph showing a dimensionless performance index value M of a Cu—Zr—B based alloy containing the copper alloy according to the second embodiment.

Values for a dimensionless performance index value M determined based on the tensile strength σ and electric conductivity δ are indicated by the symbols "●" in FIG. 6.

In FIG. 6, the symbols "■" indicate the measured results in the cases where an aging treatment was performed for the specimen at 460° C. for two hours after the cold working (cold rolling).

Furthermore, the symbols "○" indicate the measured results in the cases where a thermal treatment was performed for the specimen at 650° C. for one hour before the cold working (cold rolling).

The curve in FIG. 6 indicates a combination of the tensile strength σ and electric conductivity δ in which the dimensionless performance index value M is 400. In addition, the symbols "x" indicate the measured results obtained for the conventional copper alloy, which are described in Japanese Patent Laid-Open No. H10(1998)-183274.

As shown in FIG. 6, the dimensionless performance index value M of more than 400 which has not been heretofore achieved can be obtained over a wide range (slant line portion in FIG. 6) in this embodiment.

Herein, the nonrefractory melting method used for manufacturing the copper alloy according to this embodiment is not limited to the levitation melting and the vacuum arc melting, but electron beam melting can be used.

The shape of the bulk specimen prepared by casting is not limited to the plate shape, as the specimen may be a round bar, a block or a pipe by contriving an appropriate mold.

The cold working does not need to be limited to the rolling, since it is possible to select all working methods capable of obtaining stretching of the dual phase structure, the methods include extrusion, drawing, forging, pressing and the like.

The atmosphere and the cooling means are not particularly limited in the thermal treatment before the cold working and the aging treatment after the cold working. Note that the thermal treatment and the aging treatment should be preferably performed in the presence of an inert gas such as argon and nitrogen or in vacuum in order to reduce forming of oxidation scales.

Air-cooling and water-cooling should be preferably adopted as the cooling method when a reduction in working hours is considered.

Figure 3A:
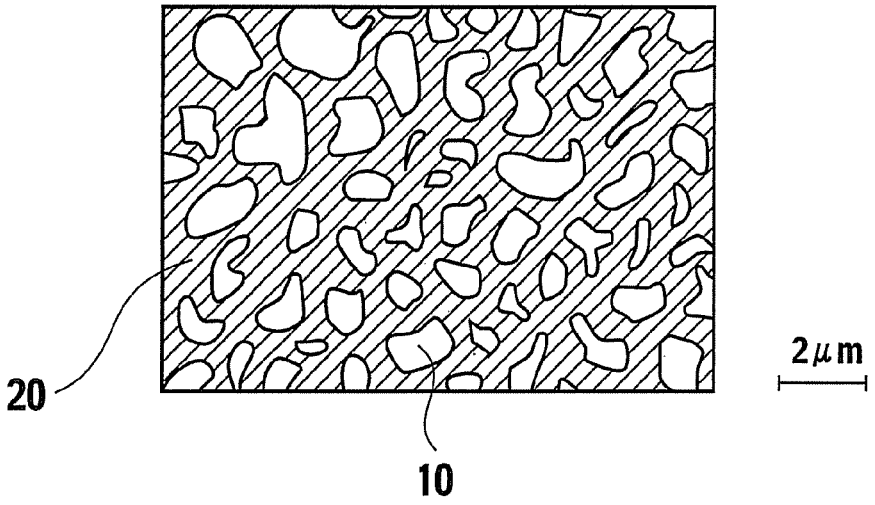
FIG. 3A is schematic views of as-cast structure of the copper alloy according to the first and second embodiment.
Figure 3B:
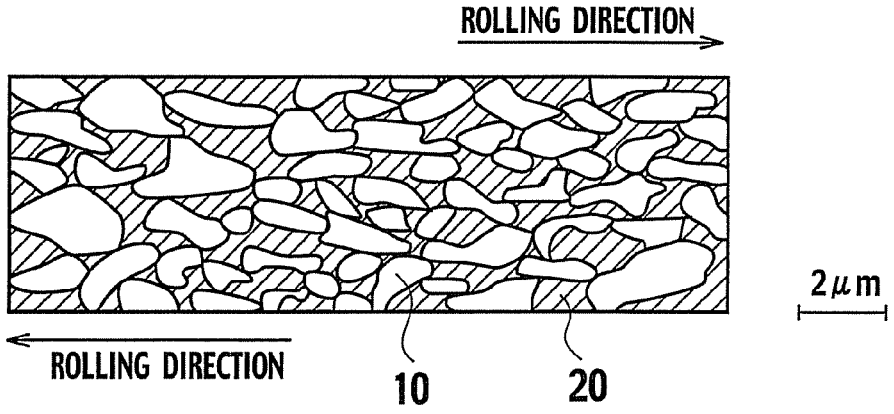
FIG. 3B is schematic views of a structure the copper alloy which has been cold-rolled after casting.
Figure 3C:
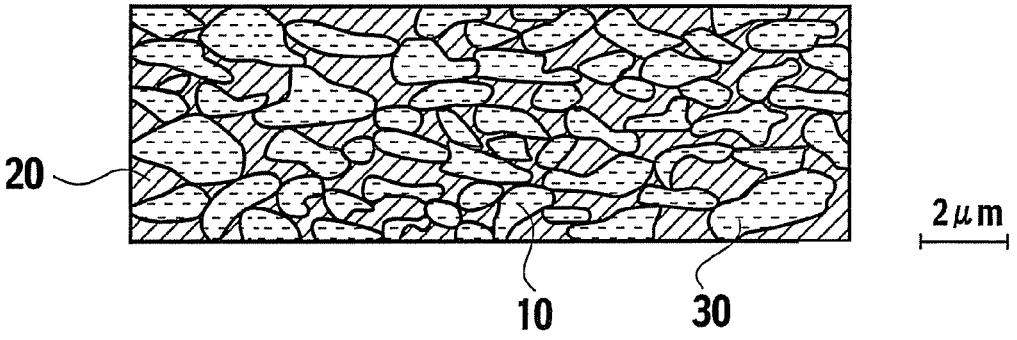
FIG. 3C is schematic views of a structure of the copper alloy which has been subjected to an aging treatment after the casting and cold rolling.

FIGS. 3A, 3B and 3C are schematic views showing a structure of the copper alloy according to the first and second embodiments. The copper alloy shown in FIG. 3A has an isotropic Cu matrix 10 in which the average diameter of the grain particles is about 10 μm or less.

The copper alloy shown in FIG. 3A constitutes a dual phase structure having a layered structure including the Cu matrix 10, and a eutectic phase 20 constituted by a Cu—Zr compound essentially containing $Cu_9Zr_2$ and a Cu—Zr—B compound.

FIG. 3B shows a structure at the time when the copper alloy shown in FIG. 3A has been subjected to cold rolling with a reduction of 90% after the casting. Grain particles constituting the Cu matrix 10 are stretched in the direction the copper alloy is processed.

In the eutectic phase 20, a shearing-sliding deformation aptly occurs, and the dual phase structure becomes layered. At the same time, a part of the grain particle comes to contact other grain particles.

Further, FIG. 3C shows a structure at the time when the copper alloy shown in FIG. 3B has been subjected to the aging treatment. As shown in FIG. 3C, precipitation 30 constituted by any of Cu—Zr compound, Cu—B compound and Cu—Zr—B compound is precipitated in the grain particles.

Figure 4:
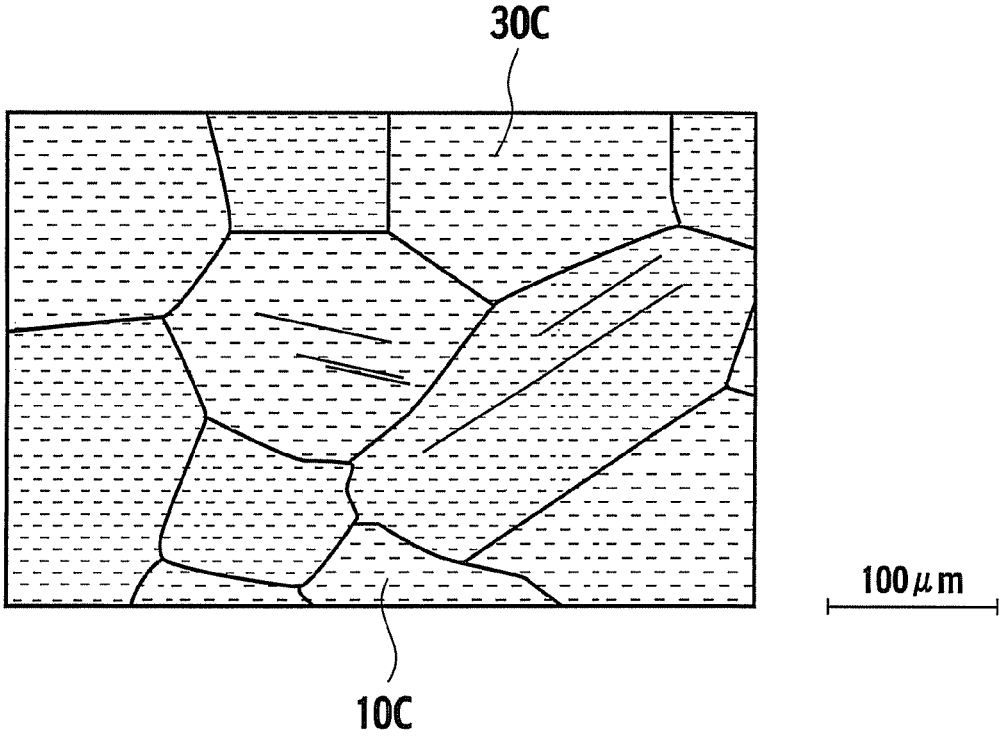
FIG. 4 is a schematic view of a typified structure of a conventional Cu—Zr based alloy.

FIG. 4 is a schematic view of a typified structure of a Cu—Zr based alloy having Cu matrix 10C and precipitation 30C. The Cu—Zr based alloy is obtained by a conventional manufacturing method (melting and casting, hot rolling, solution-heat treatment, cold rolling, and aging treatment) have been performed sequentially, as an example of a comparison with the copper alloy of the first and second embodiments shown in FIGS. 3A to 3C.

The reason why a value "a" of Zr in the copper alloy expressed by the composition formula: $Cu_{100-(a+b)}Zr_aB_b$ by atomic percent, in which $0.05 \leq a \leq 8.0$, $0 \leq b \leq 4.0$ and $a+b \leq 8.0$ is defined as follows. Specifically, when the value "a" of Zr is too small than a range expressed in the above inequalities in this embodiment, a desired structure is not formed, and the strength of the copper alloy cannot be obtained.

On the other hand, when the value "a" of Zr is too large, a decrease in the electric conductivity δ is brought about. As a result, not only the dimensionless performance index value M is less than 400, but also cold workability is disturbed.

Boron (B) in the copper alloy, without decreasing the electric conductivity δ, plays a role in constituting the structure by compensating Zr, and contributes to an improvement in the strength. Furthermore, the boron (B) suppresses coarsening of the grain particles, and improves the cold workability.

When the boron (B) is added to an amount beyond the foregoing range, the cold workability is disturbed. Incidentally, Japanese Patent Official Gazette No. 2501275 reports that the addition of the boron (B) disturbs the cold workability.

The grain particles constituting the Cu matrix should preferably have an average diameter of about 10 μm or less. When the average diameter of the grain particles is no more than 10 μm, it is possible to obtain the foregoing dual phase structure effectively.

According to the manufacturing method of this embodiment, the diameter of the grain particles is inevitably no more than 10 μm.

It is supposed that the Cu matrix is tentatively prepared so as to have the diameter of the grain particles larger than 10 μm, by means other than that defined in the manufacturing method according to this embodiment. In this case, it is anticipated that a volume ratio of the eutectic phase promoting the stretching of the dual phase structure, which occupies in the total volume of the dual phase structure decreases, and the shearing-sliding deformation of the eutectic phase is not performed smoothly.

Further, since the size of the grain particle is large, the number of grain particles contacting other grain particles and the total area of the surfaces of the grain particles contacting other grain particles decrease even if the dual phase structure is stretched by the cold working.

Accordingly, the increase in electric conductivity δ is not expected, and it is impossible to obtain the dimensionless performance index value M of more than 400.

The reason why the cold working is performed with the reduction of about 50% or more is as follows. It is difficult to obtain a layered structure when the reduction is below 50%.

If the layered structure is not obtained, the total area of the surfaces of the grain particles contacting other grain particles becomes small, and the electric conductivity δ decreases. Accordingly, the dimensionless performance index value M of more than 400 cannot be obtained.

In this embodiment, the thermal treatment prior to the cold working in the manufacturing method of the copper alloy is performed for one to five hours at a temperature in a range from 550 to 800° C. If the temperature of the thermal treatment is below 500° C., diffusion of atoms is insufficient, and re-solving of the compound does not occur.

On the other hand, if the temperature of the thermal treatment is higher than 800° C., coarsening of the crystal becomes undesirably significant.

If the treatment duration is shorter than one hour, it is insufficient to allow the compound to re-melt. If the treatment duration is longer than five hours, such treatment duration is not only inefficient, but also undesirable because such long treatment duration may lead to coarsening of the crystal grains depending on the treatment temperature.

In this embodiment, the aging treatment after the cold working in the manufacturing method of the copper alloy is performed for one to ten hours at a temperature in a range from 300 to 500° C. If the temperature of the aging treatment is below 300° C., precipitation of the Cu—Zr compound, the C—B compound or the Cu—Zr—B compound does not advance, and an effect of increasing the tensile strength of the copper alloy cannot be expected.

On the other hand, if the temperature of the aging treatment is higher than 500° C., a part of the compound begins to melt into the matrix, and the tensile strength σ decreases again.

An aging duration is determined depending on the temperature, and if the aging duration is shorter than one hour, an improvement in the tensile strength σ is not expected. If the aging duration is longer than ten hours, precipitation becomes coarse. The tensile strength σ is not only improved, but also ineffectiveness is brought about because of the long aging duration.

In the foregoing first and second embodiments of the present invention, the manufacturing method capable of suppressing mixing of elements, which disturb the improvements in tensile strength σ and electric conductivity δ by producing impurity substances such as oxide and sulfide containing oxygen (O), sulfur (S) and silicon (Si), is used. In other words, in the manufacturing method, a particular casting method such as a single rolling casting method showing a limitation in the size of manufacturing products is not used.

To be concrete, in order to suppress the mixing amount of the elements disturbing the improvements in the tensile strength σ and electric conductivity δ to be 1,000 ppm or less, the copper alloy was melted by use of the nonrefractory melting method. Subsequently, the melted copper alloy was cast at a solidification rate at which the bulk was obtained, by use of the Cu cast mold.

The dual phase structure in which around the fine grain particles (Cu matrix) having an average diameter of no more than 10 μm, the precipitation containing at least one of the Cu—Zr compound, the Cu—B compound and the Cu—Zr—B compound is dispersed in the grain particles can be obtained, and the sufficient tensile strength σ can be secured.

Furthermore, in the first and second embodiments, the cold working with the reduction of about 50% or more is performed for the bulk which has been cast, whereby the eutectic phase is allowed to cause the shearing-sliding deformation preferentially.

When the eutectic phase causes the shearing-sliding deformation, the eutectic phase stretches in a direction where the dual phase structure is worked, and the Cu matrix also deforms and stretches. Therefore, a part of the grain particle comes to contact other grain particles, and such a contact of the grain particle with other grain particle promotes smooth flowing of free electrons, thus improving the electric conductivity δ.

Herein, by adding the boron (B), it is possible to easily obtain the eutectic phase and to improve the workability of the copper alloy. When the workability of the copper alloy is improved, the total contact area of the grain particles increases, and the electric conductivity δ can be further increased.

(Other Embodiments)

Next, other embodiments of the copper alloy according to the present invention will be described. Table below shows a composition of the specimen according to the embodiments. In the embodiments, as the specimen, the specimens of the embodiments 1 through 17, the specimens of the comparison examples 1 through 6, and the specimens of the conventional example 7 through 11 (described in the literature) were used.

The melting methods, etc., such as solidification material (solidification mode), refractory, cast dimension, treatment before working, yield of cold working and aging treatment, are also shown.

ing to the embodiments 8 and 16, both of the thermal and aging treatments are performed.

For the copper alloys according to the embodiments 6 and 14, only the thermal treatment before the cold working is performed. For the copper alloys according to the embodiments 7 and 15, only the aging treatment after the cold working is performed.

The cold working of the copper alloys was performed by rolling. Further, the thermal treatment and aging treatment were performed in the presence of nitrogen in an electric furnace. The air cooling was adopted as the cooling method.

Table below shows presence or absence of the two-phase structure, presence or absence of the layered structure, the

| | COMPOSITION (at %) | MELTING METHOD | SOLIDIFICATION FORM | REFRACTORY | CAST DIMENSION THICKNESS (mm) | TREATMENT BEFORE WORKING TEMP. × DURATION | REDUCTION OF COLD WORKING % | AGEING TREATMENT TEMP × DURATION |
|---|---|---|---|---|---|---|---|---|
| EMBODIMENT 1 | Cu—0.1Zr | NONREFRACTORY | BULK | — | 10 | — | 98 | — |
| EMBODIMENT 2 | Cu—1.0Zr | NONREFRACTORY | BULK | — | 10 | — | 98 | — |
| EMBODIMENT 3 | Cu—3.0Zr | NONREFRACTORY | BULK | — | 25 | — | 95 | — |
| EMBODIMENT 4 | Cu—5.0Zr | NONREFRACTORY | BULK | — | 25 | — | 90 | — |
| EMBODIMENT 5 | Cu—8.0Zr | NONREFRACTORY | BULK | — | 10 | — | 85 | — |
| EMBODIMENT 6 | Cu—8.0Zr | NONREFRACTORY | BULK | — | 10 | 650° C. × 1 h | 95 | — |
| EMBODIMENT 7 | Cu—5.0Zr | NONREFRACTORY | BULK | — | 10 | — | 97 | 450° C. × 2 h |
| EMBODIMENT 8 | Cu—1.0Zr | NONREFRACTORY | BULK | — | 10 | 650° C. × 1 h | 98 | 450° C. × 2 h |
| EMBODIMENT 9 | Cu—8.0Zr | NONREFRACTORY | BULK | — | 10 | — | 55 | — |
| EMBODIMENT 10 | Cu—0.1Zr—0.05B | NONREFRACTORY | BULK | — | 25 | — | 97 | — |
| EMBODIMENT 11 | Cu—1.0Zr—0.3B | NONREFRACTORY | BULK | — | 25 | — | 90 | — |
| EMBODIMENT 12 | Cu—2.0Zr—1.0B | NONREFRACTORY | BULK | — | 10 | — | 90 | — |
| EMBODIMENT 13 | Cu—4.0Zr—3.9B | NONREFRACTORY | BULK | — | 10 | — | 88 | — |
| EMBODIMENT 14 | Cu—3.0Zr—2.0B | NONREFRACTORY | BULK | — | 25 | 650° C. × 1 h | 97 | — |
| EMBODIMENT 15 | Cu—3.0Zr—2.0B | NONREFRACTORY | BULK | — | 25 | — | 90 | 460° C. × 2 h |
| EMBODIMENT 16 | Cu—3.0Zr—2.0B | NONREFRACTORY | BULK | — | 25 | 650° C. × 1 h | 92 | 460° C. × 2 h |
| EMBODIMENT 17 | Cu—3.0Zr—2.0B | NONREFRACTORY | BULK | — | 25 | — | 53 | — |
| COMPARISON EXAMPLE 1 | Cu—0.03Zr | NONREFRACTORY | BULK | — | 10 | — | 96 | — |
| COMPARISON EXAMPLE 2 | Cu—8.3Zr | NONREFRACTORY | BULK | — | 10 | — | ROLLING IMPOSSIBLE | — |
| COMPARISON EXAMPLE 3 | Cu—3.0Zr | CRUCIBLE | BULK | ALUMINA | 10 | — | 95 | — |
| COMPARISON EXAMPLE 4 | Cu—3.0Zr | NONREFRACTORY | BULK | — | 10 | 820° C. × 1 h | 95 | — |
| COMPARISON EXAMPLE 5 | Cu—3.0Zr | NONREFRACTORY | BULK | — | 10 | — | 95 | 600° C. × 2 h |
| COMPARISON EXAMPLE 6 | Cu—3.0Zr | NONREFRACTORY | BULK | — | 10 | — | 44 | — |
| CONVENTIONAL EXAMPLE 7 | Cu—0.023Zr | CRUCIBLE | BULK | ALUMINA | CAST BLOCK | 900° C. × 0.5 h | 95 | 550° C. × 1 h |
| CONVENTIONAL EXAMPLE 8 | Cu—0.17Zr—0.3Cr | NONREFRACTORY | BULK | CARBON | 30 mm | 900° C. × 0.5 h | 90 | — |
| CONVENTIONAL EXAMPLE 9 | Cu—5.0Zr | SINGLE ROLLER | FOIL | QUARTZ | 30 μm | — | — | — |
| CONVENTIONAL EXAMPLE 10 | Cu—3.0Zr—2.0Cr | NONREFRACTORY | BULK | QUARTZ | 30 μm | — | — | — |
| CONVENTIONAL EXAMPLE 11 | Cu—3.0Zr—2.0Ti | NONREFRACTORY | BULK | QUARTZ | 30 μm | — | — | — |

The copper alloys according to the embodiments 1 through 17 are obtained by melting and casting by use of the nonrefractory melting method. To be concrete, in the embodiments 1, 2, 5, 6, 7, 8, 9, 12 and 13, the levitation melting is used. In the embodiments 3, 4, 10, 11, 14, 15, 16 and 17, the vacuum arc melting is used.

For the copper alloys according to the embodiments 1, 2, 3, 4, 5, 9, 10, 11, 12, 13 and 17, the thermal treatment and the aging treatment before and after the cold working are not performed. On the other hand, for the copper alloys according grain diameter of the matrix, the tensile strength σ, the electric conductivity δ and the dimensionless performance index value M for each specimen.

Herein, the "dual phase structure" means a dual phase structure in which a part of a grain particle constituting the Cu matrix contacts other grain particles. Furthermore, the "layered structure" means a layered structure formed of the Cu matrix and the eutectic phase composed of a Cu matrix and at least one of the Cu—Zr compound and the Cu—Zr—B compound.

| | DUAL PHASE STRUCTURE | LAYERED STRUCTURE | GRAIN DIAMETER OF MATRIX μm | σ MPa | δ % IACS | M σ × δ |
|---|---|---|---|---|---|---|
| EMBODIMENT 1 | YES | YES | 4 | 540 | 76 | 410 |
| EMBODIMENT 2 | YES | YES | 3 | 670 | 64 | 428 |
| EMBODIMENT 3 | YES | YES | 2 | 900 | 45 | 405 |
| EMBODIMENT 4 | YES | YES | 3 | 1,100 | 38 | 418 |
| EMBODIMENT 5 | YES | YES | 2 | 1,250 | 37 | 475 |
| EMBODIMENT 6 | YES | YES | 2 | 1,230 | 40 | 492 |
| EMBODIMENT 7 | YES | YES | 3 | 1,120 | 41 | 459 |
| EMBODIMENT 8 | YES | YES | 2 | 690 | 67 | 462 |
| EMBODIMENT 9 | YES | YES | 3 | 1,100 | 37 | 407 |
| EMBODIMENT 10 | YES | YES | 5 | 490 | 86 | 421 |
| EMBODIMENT 11 | YES | YES | 3 | 650 | 67 | 435 |
| EMBODIMENT 12 | YES | YES | 2 | 790 | 61 | 481 |
| EMBODIMENT 13 | YES | YES | 2 | 1,090 | 39 | 425 |
| EMBODIMENT 14 | YES | YES | 2 | 1,120 | 38 | 425 |
| EMBODIMENT 15 | YES | YES | 2 | 1,120 | 40 | 448 |
| EMBODIMENT 16 | YES | YES | 2 | 1,120 | 41 | 458 |
| EMBODIMENT 17 | YES | YES | 4 | 1,100 | 38 | 418 |
| COMPARISON EXAMPLE 1 | NO | NO | 40 | 350 | 95 | 332 |
| COMPARISON EXAMPLE 2 | YES | NO | 4 | NO DATA | NO DATA | NO DATA |
| COMPARISON EXAMPLE 3 | NO | NO | 20 | 400 | 85 | 340 |
| COMPARISON EXAMPLE 4 | YES | YES | 30 | 800 | 40 | 320 |
| COMPARISON EXAMPLE 5 | YES | YES | 15 | 820 | 47 | 385 |
| COMPARISON EXAMPLE 6 | YES | NO | 12 | 880 | 30 | 264 |
| CONVENTIONAL EXAMPLE 7 | NO | NO | 300 | 310 | 90 | 279 |
| CONVENTIONAL EXAMPLE 8 | NO | NO | 380 | 450 | 77 | 346 |
| CONVENTIONAL EXAMPLE 9 | YES | NO | <1 | 1,080 | 24 | 259 |
| CONVENTIONAL EXAMPLE 10 | NO | NO | 25 | 670 | 5 | 33 |
| CONVENTIONAL EXAMPLE 11 | NO | NO | 30 | 780 | 5 | 39 |

In order to judge the constitution of the structure, an observation by use of an electron microscope was mainly performed for the copper alloys according to the embodiments. Note that an observation by use of an optical microscope was performed complementarily. Furthermore, for the copper alloys according to the comparison examples, an observation by use of the optical microscope was performed.

The tensile strength σ of the specimen was obtained by a tensile test, and the electric conductivity δ was obtained in such a manner that after measuring an electric resistance of the specimen at room temperature, a ratio (% IACS) of the measured electric resistance to that of pure copper was calculated.

As shown in the table, the copper alloys according to the embodiments 1 through 17 have the dual phase structure and the layered structure, and the tensile strength a thereof ranges from 490 to 1250 MPa. In addition, the electric conductivity δ of the copper alloys ranges from 37 to 86% IACS, and the dimensionless performance index value M ranges from 405 to 492.

Specifically, the copper alloys achieve the dimensionless performance index value M of more than 400, and have both the tensile strength σ and electric conductivity δ.

On the other hand, the copper alloys according to the comparison examples 1 through 6 and the conventional examples 7 through 11 have the dimensionless performance index value M equal to 385 at a maximum, and cannot achieve the dimensionless performance index value M of more than 400. Specifically, it is understood that the copper alloys according to the embodiments 1 through 17 are excellent in the tensile strength σ and the electric conductivity δ.

Among the copper alloys according to the comparison examples, the copper alloy of the comparison example 4 showing a high dimensionless performance index value M, which is 320, and the copper alloy of the comparison example 5, which is 385, were made in the same manner as that for the copper alloy according to the embodiments.

The difference between the embodiments and the comparison examples 4, 5 is the temperature conditions of the thermal and aging treatments before and after the cold working. Specifically, the copper alloy of the comparison example 4 was subjected, for one hour at 820° C., to the thermal treatment before the cold working. Further, the copper alloy of the comparison example 5 was subjected, for two hours at 600° C., to the aging treatment after the cold working.

As described above, for the copper alloys of the comparison examples 4 and 5, the temperature of the thermal and aging treatments before and after the cold working are higher than the temperature for the copper alloys of the embodiments. Owing to the high temperatures, the average diameter of the grain particles constituting the Cu matrix is 30 μm in the thermal treatment before the cold working.

Further, in the aging treatment after the cold working, a re-precipitation of the compound containing Zr and B, which are solid-solved in the Cu matrix, is inhibited. Then, the average diameter of the grain particles becomes coarser beyond 10 μm.

Due to coarsening of the grain particles, the copper alloys of the comparison examples 4 and 5 have the tensile strength σ of 800 to 820 MPa and the electric conductivity δ of 40 to 40% IACS. Therefore, the values for the dimensionless performance index value M become 320 to 385, not as high as M>400.

On the other hand, in the embodiments 1 to 17, an average diameter of the grain particles constituting the Cu matrix is 2 to 5 μm, and it is understood that it is important that the average diameter of the grain particles is no more than 10 μm.

The difference of the dimensionless performance index value M depending on the presence or absence of the aging treatment can be judged by comparing the copper alloys of the embodiments 4 and 7, or by comparing the copper alloys of the embodiments 14 and 16.

To be concrete, the dimensionless performance index value M of the copper alloys of the embodiments 7 and 16, which have been subjected to the aging treatment, are larger than the copper alloys of the embodiments 4 and 14, which have not been subjected to the aging treatment.

The reason why the dimensionless performance index values are different is that since solid-solution of the compound containing Zr and B in the Cu matrix occurs and the compound precipitates in the Cu matrix again, the tensile strength σ and the electric conductivity δ are further increased.

Specifically, it is understood that in the dual phase structure, the value of the dimensionless performance index value M increases by dispersing the precipitation containing at least one of the Cu—Zr compound, the Cu—B compound and the Cu—Zr—B compound in the grain particles.

Since the copper alloys according to the embodiments 1 through 17 do not cause re-solving until the aging temperature exceeds 500° C., it is understood that these copper alloys also have excellent heat-resistance property.

Coincidentally, for the copper alloy of the comparison example 2, rolling was stopped because of the occurrence of significant cracks during rolling. Accordingly, it was impossible to measure the tensile strength σ, etc.

While the invention is described through the above exemplary embodiments, it will be understood by those of ordinary skill in the art that modification and variation of the illustrated embodiments may be made without departing from the inventive concepts herein disclosed. Modifications and alternations of the device of the present invention can be carried out without departing from the scope and spirit of the present invention as defined by the appended claims. Accordingly, the specification and drawings are to be regarded in an illustration rather than a restrictive sense.

What is claimed is:

1. A method of manufacturing a copper alloy, comprising the steps of:

melting a copper alloy by levitation melting, vacuum arc melting or electron beam melting, said alloy having a composition expressed, in atomic percent, by a composition formula of $$Cu_{100-(a+b)}Zr_aB_b,$$

wherein $$1.0<a<8.0,\ 0<b<4.0,$$

and $$a+b<8.0,$$

casting a melt obtained by the melting step in a mold to produce a bulk copper alloy; and performing cold working with a reduction of about 50% or more for said bulk copper alloy without a solution treatment to provide said copper alloy having a dual phase, layered structure including a Cu matrix phase comprising a plurality of grains having an average diameter of about 2μm or more and 10μm or less, and a eutectic phase around said Cu matrix phase;

wherein at least part of each of said grains contacts another of said grains within said eutectic phase, and wherein said eutectic phase comprises at least one of a Cu—Zr compound and a Cu—Zr—B compound.

2. The method of manufacturing a copper alloy according to claim 1, wherein a precipitation including at least one of a Cu—Zr compound, a Cu—B compound and a Cu—Zr—B compound is dispersed in said grains of said Cu matrix phase.

* * * * *